US005673505A

United States Patent [19]

Phillips

[11] Patent Number: 5,673,505

[45] Date of Patent: Oct. 7, 1997

[54] FALLING BREECHBLOCK ACTION FOR A SINGLE SHOT FIREARM

[76] Inventor: Mark Phillips, P.O. Box 163, Caledon East, Ontario, Canada, L0N 1E0

[21] Appl. No.: 762,594

[22] Filed: Dec. 9, 1996

[51] Int. Cl.[6] ..... F41A 15/10; F41C 7/06

[52] U.S. Cl. ..... 42/23; 89/24

[58] Field of Search ..... 42/23, 24; 89/24

[56] References Cited

U.S. PATENT DOCUMENTS

| | | | |
|---|---|---|---|
| 2,749,641 | 6/1956 | Hauck | 47/23 |
| 3,735,517 | 5/1973 | De Haas et al. | 42/23 |
| 3,830,000 | 8/1974 | Browning | 42/23 |
| 4,040,196 | 8/1977 | Smith et al. | 42/23 |

*Primary Examiner*—Stephen M. Johnson

[57] ABSTRACT

A falling breechblock action for a single shot firearm, which is easy to make, assemble and disassemble, has an internal firing mechanism and a cooperating underlever. The action has a trigger, a hammer, an extractor and an extractor retainer, and avoids indirect linkages and cams and traditional complex safety mechanisms. The action links the underlever directly to the firing mechanism with a shaft. The underlever indirectly moves the breechblock. The initial downward movement of the underlever rotates the hammer rearwards into the cocked position and renders the complete mechanism safe. Further downward movement of the underlever draws down the breechblock. In so doing, the extractor is actuated by the breechblock. Upward movement of the underlever initially raises the breechblock and subsequently compresses a mainspring which is coaxial with the shaft. Only with the underlever fully up is the action capable of discharging a cartridge. A unique extractor assembly has an extractor with a heel and toe which cooperates with the breechblock to pivot the extractor, and allows the breechblock travel to be regulated for various cartridge sizes. The extractor assembly is removable, thus allowing very rapid disassembly of the entire mechanism.

20 Claims, 7 Drawing Sheets

FALLING BREECHBLOCK ACTION FOR A SINGLE SHOT FIREARM

FIELD OF THE INVENTION

The present invention relates to a single shot firearm, e.g. a rifle, specifically to a single shot firearm having a falling breechblock and an internal firing mechanism operated by a lever.

BACKGROUND TO THE INVENTION

A variety of falling breechblock rifles are known. Examples of such rifles are disclosed in U.S. Pat. No. 2,289,098 which issued Jul. 7, 1942 to J. R. Buhmiller, U.S. Pat. No. 2,749,641 which issued Jun. 12, 1956 to W. J. Hauck, U.S. Pat. No. 3,355,833 which issued Dec. 5, 1967 to W. B. Ruger et al., U.S. Pat. No. 3,735,517 which issued May 29, 1973 to De Haas et al., U.S. Pat. No. 4,095,365 which issued Jun. 20, 1978 to J. L. Riedl and U.S. Pat. No. 4,879,827 which issued Nov. 14, 1989 to R. Gentry. The most popular falling breechblock rifle on the market is the Ruger rifle, which is covered by U.S. Pat. No. 3,355,833. The drawbacks of falling breechblock actions made heretofore have been that they tend to be complex, which among other things, makes assembly and disassembly time consuming. In addition, in some rifles, tolerances are critical for functionality and safety.

There is a need for a breechblock mechanism which is relatively simple and does not require particularly close tolerances, while at the same time providing a functional and safe firearm. There is also a need for a breechblock mechanism that is easy to clean and maintain. The present invention is directed to a relatively inexpensive, simple and effective breechblock mechanism for a single shot firearm.

SUMMARY OF THE INVENTION

Accordingly the invention provides a falling breechblock action for a single shot firearm which has an internal firing mechanism, comprising:

(a) a receiver mounted on one end of a barrel, and the receiver has a forward portion which joins the barrel, and a rearward portion separated from the forward portion by opposing sides, in which said sides, forward and rearward portions define an interior of the receiver;

(b) a breechblock which has a front face and upward, downward, rearward and frontward directions, said breechblock being separate from the receiver and slidable downwards and upwards within the interior of the receiver, said breechblock has a main cavity therein which is closed in the upward direction and open in the downward direction;

(c) an underlever which is pivotable about an axis adjacent the forward portion of the receiver;

(d) means for releasably holding the underlever in contact with substantially all of the underside of the receiver;

(e) a trigger which is pivotable about a transverse trigger pivot within the main breechblock cavity;

(f) a hammer which is pivotable about a transverse hammer pivot in the main cavity between a cocked position and a forward position, said trigger and hammer having cooperating latching means for releasably engaging said trigger and hammer in the cocked position; and (g) hammer control means which comprises a shaft, one end of which is pivotably linked to the hammer about a shaft link pivot which is rotatable about a transverse axis rearward of the hammer pivot, said shaft having an opposing end with stop means, and said shaft passes through a guide aperture in the underlever, and said shaft has an associated compression spring which is compressed between the shaft link pivot and material which surrounds the guide aperture.

In one embodiment the latching means for the trigger and hammer is a cooperating sear and indented sear catch.

In another embodiment the trigger is spring biased towards a latched position for the latching means.

In a further embodiment the guide aperture and the material surrounding the guide aperture comprises a shaft pivot which is rotatable about a transverse axis in the underlever, in a pivot bearing in the underlever, said shaft pivot has a diametric aperture therethrough, perpendicular to the transverse axis, and the shaft has an associated compression spring which is compressed between the shaft pivot and the shaft link pivot.

In yet another embodiment the stop means is a nut which is threadedly attached to the shaft.

In a further embodiment there is a small gap between the stop means and the shaft pivot when the underlever is held in contact with the underside of the receiver.

In another embodiment the means for releasably holding the underlever in contact with the underside of the receiver is a latching means.

In yet another embodiment, the falling breechblock action additionally has:

(i) an extractor chamber in the receiver, wherein the extractor chamber is open in the rearward and downward directions and has a retainer bore leading from the chamber for retaining an extractor retaining means, said retainer bore having a longitudinal axis substantially parallel to a longitudinal axis of the barrel, and said receiver has an underside;

(j) the front of the breechblock having an extractor aperture communicable with the extractor chamber; and (k) an extractor which is pivotable within the extractor chamber about a transverse extractor pivot, and said extractor has an extractor arm extending upwardly from the extractor pivot, and an extractor foot extending from the extractor pivot substantially perpendicularly to the extractor arm, said foot having a toe and heel, and said foot extending into the breechblock aperture, said extractor being held in position by a removable extractor retaining means, such that the extractor pivot is in contact with the front face of the breechblock.

In a further embodiment the extractor aperture in the breechblock has upper and lower surfaces, said upper surface is cooperable with the toe of the extractor when in a cartridge ejection position to rotate the toe about the extractor pivot and cause the extractor arm to catch a rear portion of a cartridge and eject the cartridge rearwardly from the barrel.

In another embodiment the extractor arm is shaped to catch a rim of a cartridge.

In another embodiment the lower surface of the extractor aperture in the breech block is cooperable with the heel of the extractor.

In a further embodiment the extractor retaining means is a spring biased plunger with first bearing surfaces which bear upon the extractor pivot, urging the plunger into contact with the front face of the breechblock.

In yet another embodiment the plunger has a second bearing surface which bears upon a lower portion of the extractor arm when the extractor is in the ejection position, urging the extractor to rotate about the extractor pivot.

The present invention also provides an extractor mechanism for a single shot firearm, comprising:

(a) a receiver mounted on one end of a barrel, and the receiver has an underside, a forward portion which joins the barrel, and a rearward portion separated from the forward portion by opposing sides, in which said sides, forward and rearward portions define an interior of the receiver, said receiver having an extractor chamber which is open in the rearward and downward directions and has a retainer bore for retaining an extractor retaining means, said retainer bore having a longitudinal axis substantially parallel to a longitudinal axis of the barrel;

(b) a breechblock which has a front face and upward, downward, rearward and frontward directions, said breechblock being separate from the receiver and slidable downwards and upwards within the interior of the receiver, the front face of the breechblock having an extractor aperture communicable with the extractor chamber.

(c) an extractor which is pivotable within the extractor chamber about a transverse extractor pivot, said extractor has an extractor arm extending upwardly from the extractor pivot, and an extractor foot extending from the extractor pivot substantially perpendicularly to the extractor arm, said foot having a toe and heel, and said foot extending into the breechblock aperture, said extractor being held in position by a removable extractor retaining means, such that the extractor pivot is in contact with the front face of the breechblock.

In a further embodiment the extractor aperture in the breechblock has upper and lower surfaces, said upper surface is cooperable with the toe of the extractor when in a cartridge ejection position to rotate the toe about the extractor pivot and cause the extractor arm to catch a rear portion of a cartridge and eject the cartridge rearwardly from the barrel.

In another embodiment the extractor arm is shaped to catch a rim of a cartridge.

DETAILED DESCRIPTION OF PREFERRED EMBODIMENTS

Figure 1:
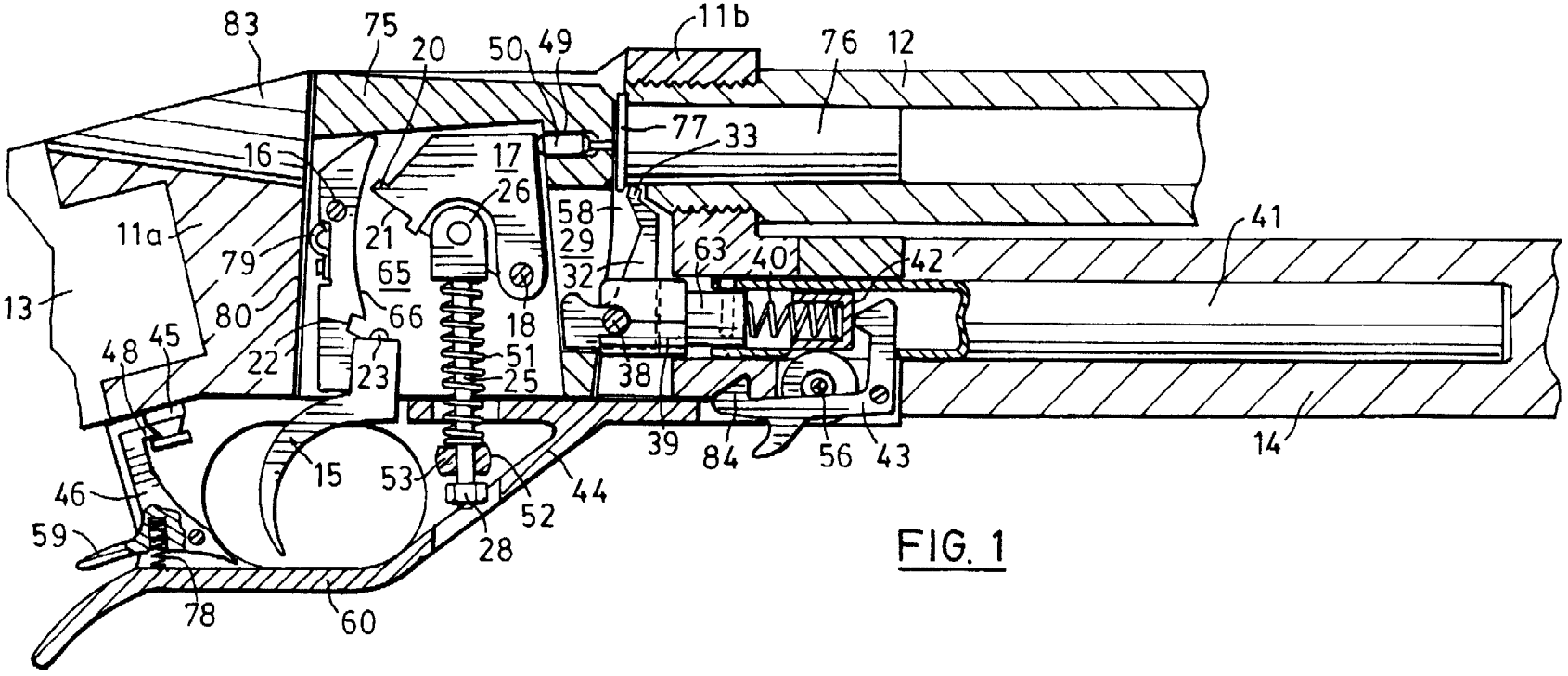
FIG. 1 is a cross-sectional view of a receiver and breechblock mechanism of the present invention in a fired position.
Figure 1A:
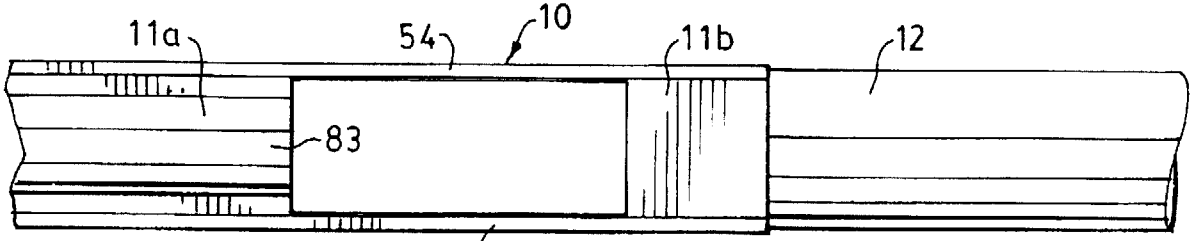
FIG. 1A is a plan view of the receiver of FIG. 1.

The breechblock mechanism for a single shot firearm, which is illustrated in the drawings, comprises a receiver 10 to which a barrel 12 and butt stock 13 are attached. The forearm 14 may be attached to barrel 12 or may be free floating, as is known in the art. Preferably the forearm is free floating, for improving the accuracy of the firearm.

Figure 3:
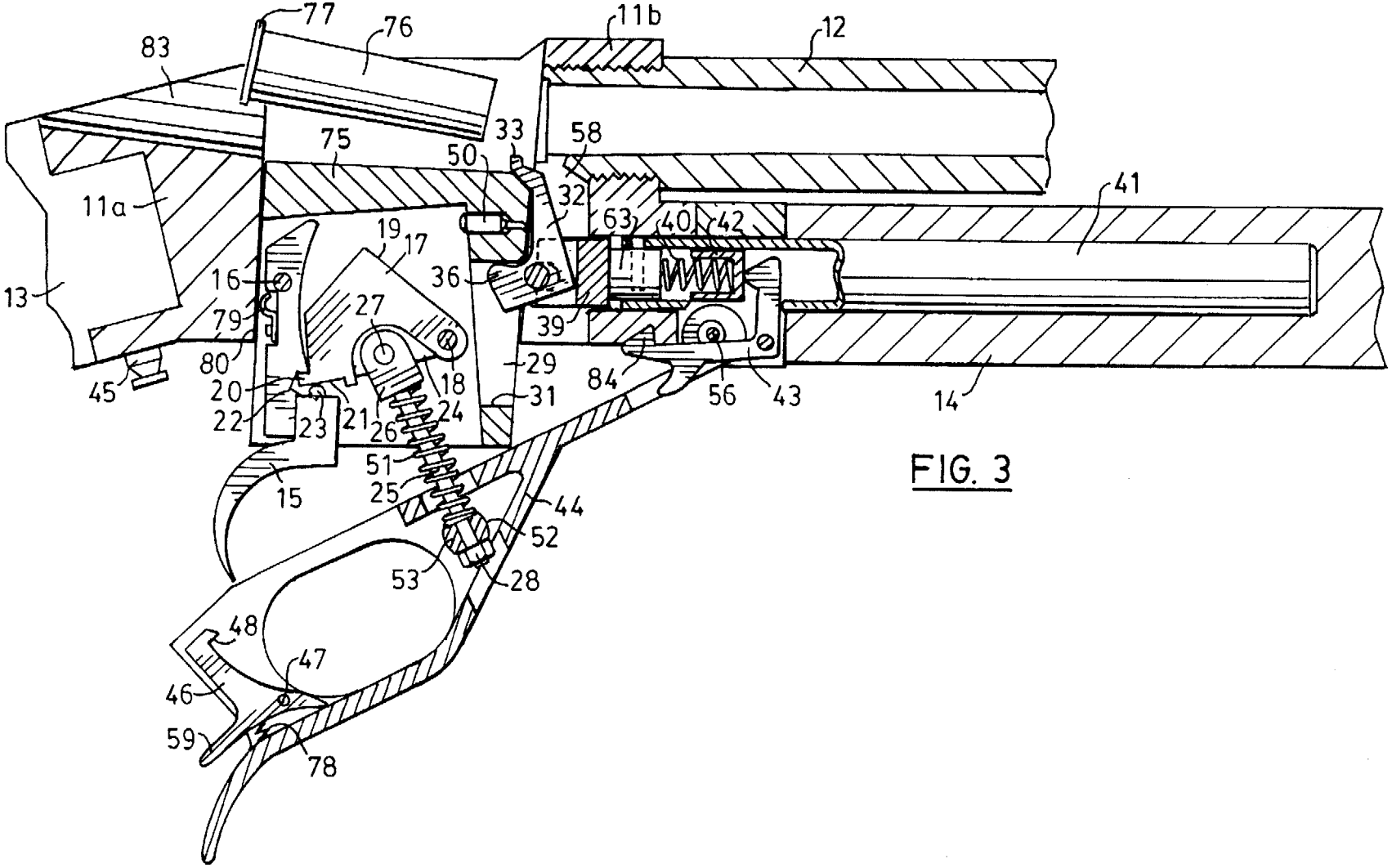
FIG. 3 is a cross-sectional view of the breechblock mechanism of FIG. 1 but in a cartridge ejection position.

Receiver 10 comprises rear portion 11*a*, front portion 11*b* and side plates 54. Breechblock 75 can move up or down within the cavity defined by the receiver 10. In the upward position of breechblock 75, as shown in FIG. 1, the breechblock end of barrel 12 is completely closed by the breechblock 75. In the lowered position, as shown in FIG. 3, the breechblock end of barrel 12 is completely open to allow insertion of a cartridge into a cartridge chamber (not numbered) in barrel 12. Breechblock 75 may be removed completely from receiver 10, as will be described in more detail hereinafter.

The rear portion 11*a* of receiver 10 has a lever latch post 45 attached to the underside thereof. Rear portion 11*a* also has a channel 83 along the upper side thereof, for ease of insertion of a loaded cartridge 81 and removal of a spent cartridge 76 when breechblock 75 is in its lowered position, as will be described in more detail hereinafter. The front portion 11*b* of receiver 10 has a threaded aperture to which barrel 12 is threadedly attached. The forward portion 11*b* of receiver 10 also has an extractor chamber 58 and retainer bore 57 which extends parallel to and underneath barrel 12. Retainer bore 57 (as seen more clearly in FIG. 7) extends into extractor chamber 58 at the lower rear of front portion 11*b*.

Breechblock 75 has a large cavity 65 in which a trigger and hammer assembly is housed. Trigger 15 is pivotally attached to the side or sides of breechblock 75 by pivot pin 16. Hammer 17 is pivotally attached to the sides of breechblock 75 by pivot pin 18. Breechblock 75 has a firing pin hole 49 in the front of the breechblock, adjacent to the cartridge chamber. Firing pin 50 may travel back and forth in firing pin hole 49, as will be understood by those skilled in the art. It will also be understood by those skilled in the art that the firing pin may be attached directly to the hammer rather than being separated therefrom as shown in the drawings. Breechblock 75 also has a front aperture 29 in the forward part of breechblock 75 which cooperates with a portion of extractor 32, as will be explained hereinafter in more detail.

Underlever 44 is pivotally attached to the firearm by pivot pin 56. Underlever 44 has a trigger guard 60. To the rear of trigger guard 60, there is located an L-shaped lever latch 46, which has an arm 59 and a catch 48. Lever latch 46 is pivotable about pivot pin 47. Catch 48 is adapted to engage with a detent in lever latch post 45. Lever latch 46 is sprung biased, with spring 78, to be in locking relationship with lever latch post 45, as shown in FIG. 1.

Lever arm 44 has a transverse hole 52 in which is situated shaft pivot 53. Shaft pivot 53 is rotatable within hole 52. Shaft pivot 53 has a hole therethrough, across its diameter, through which shaft 25 passes. One end of shaft 25 has a shaft nut 28 attached thereto. The opposing end of shaft 25 has a pivot linkage 26 which is pivotally attached to hammer 17 by pivot pin 27. Pivot linkage 26 is housed within cavity 24 of hammer 17. Coaxial with, and surrounding shaft 25 is a compression spring 51 which presses against pivot linkage 26 and shaft pivot 53.

To simplify construction of the lever arm, it is possible to dispense with shaft pivot 53 and rely only on an aperture (sometimes referred to as a guide aperture) in the underlever to permit movement of shaft 25 therethrough. Clearly, if this arrangement is used, the guide aperture must have a sufficiently large internal diameter to allow easy movement of shaft 25 therethrough but sufficiently small internal diameter to prevent stop nut 28 from also passing though the aperture.

Figure 6A:
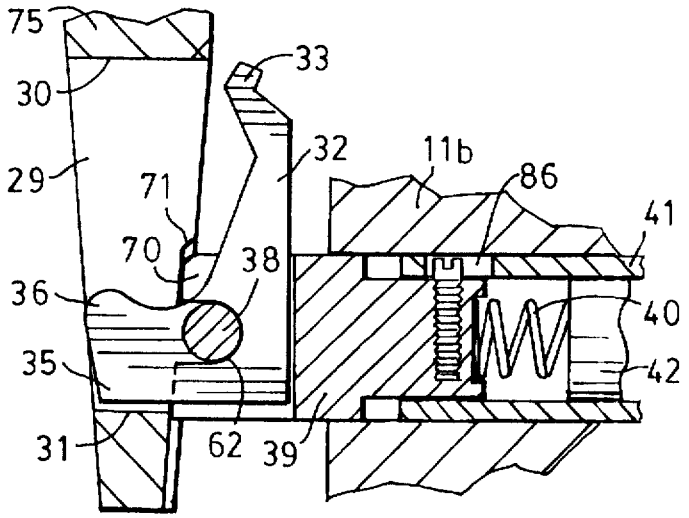
FIGS. 6A and 6B are cross-sectional views of an extractor and extractor retainer of the present invention in different operating positions.
Figure 6B:
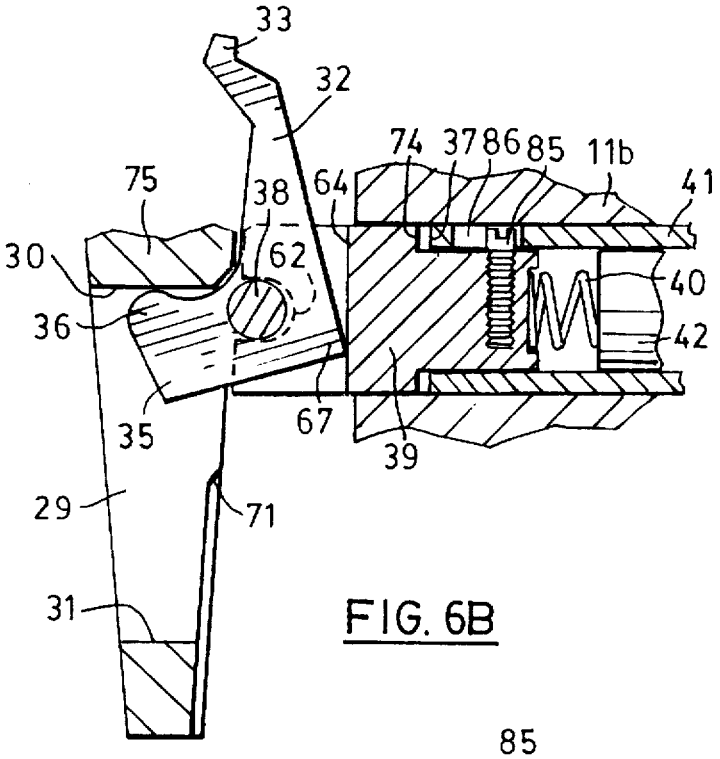
Figure 6C:
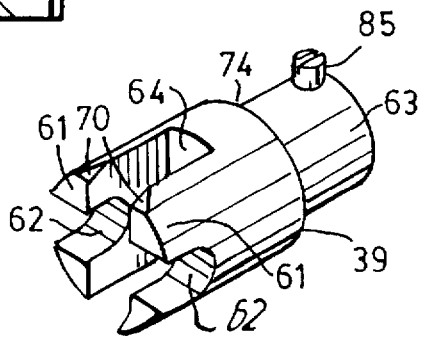
FIG. 6C is a three-quarter view of an extractor retainer used with the extractor of FIGS. 6A and 6B.

Extractor 32 is L-shaped and has an extractor tip 33 which is adapted to engage with a rim on a cartridge, when the cartridge is in the cartridge chamber. Other extractor tips may be used for cartridges without rims, as will be apparent to those skilled in the art. The opposing end of the L-shape has a foot with a heel 35 and toe 36, as best seen in FIGS. 6A and 6B. Extractor 32 also has a pivot pin 38 attached thereto, which is not attached to any other part. Extractor 32 is situated within cavity 58 of the front portion 11*b* of receiver 10. Extractor retainer 39 is cooperable with extractor 32. As seen more clearly in FIG. 6B, extractor retainer 39 has two spuds 61 which straddle on either side of extractor 32. Each spud has a pivot locating slot 62 in which pivot 38 may be situated. Extractor retainer 39 also has plunger 63 attached thereto. At the juncture of spuds 61 and plunger 63 there is a shoulder 74, and between spuds 61 there is an inner bearing surface 64. Plunger 63 is situated within fore-end tube 41 and is able to travel a short distance therein. Extractor retainer 39 is held in place by compression spring 40 which bears upon plunger 63 and piston 42. Piston 42 is held in place by a fore-end latch 43. Extractor retainer 39 is prevented from becoming totally disengaged from extractor 32 by shoulder 74 coming into contact with an adjacent end 37 of fore-end tube 41, as seen more clearly in FIGS. 6A, 6B and 7.

As indicated before, FIG. 1 shows the breech mechanism in the closed position. It may also be referred to as a locked and uncocked position or a fired position. In this position, underlever 44 is held in position by engagement of latch 46 and latch post 45. In this position the underside of both the forward and rear portions of receiver 10 is in contact with underlever 44. The breechblock 75 is prevented from dropping with the aid of extractor retainer 39, as will be explained more fully hereinafter, and by being in contact with underlever 44. Breechblock 75 is prevented from upward movement by the heel 35 of extractor 32, which seats upon lower step 31 of front aperture 29. The hammer 17 is pressed against firing pin 50 as a result of the force engendered by compression spring 51. It should be noted that shaft nut 28 is not in contact with shaft pivot 53, i.e. there is a small gap between shaft nut 28 and shaft pivot 53. The function of the gap will be explained in more detail in relation to FIGS. 2 to 5. Compression spring 51 is able to exert pressure between shaft pivot 53 and shaft linkage 26.

Trigger 15 has detent 22 and stop surface 23. Hammer 17 has a sear 20 which may engage with detent 22. Hammer 17 also has surface 21 adjacent to sear 20 which may be seated against stop surface 23.

Figure 2:
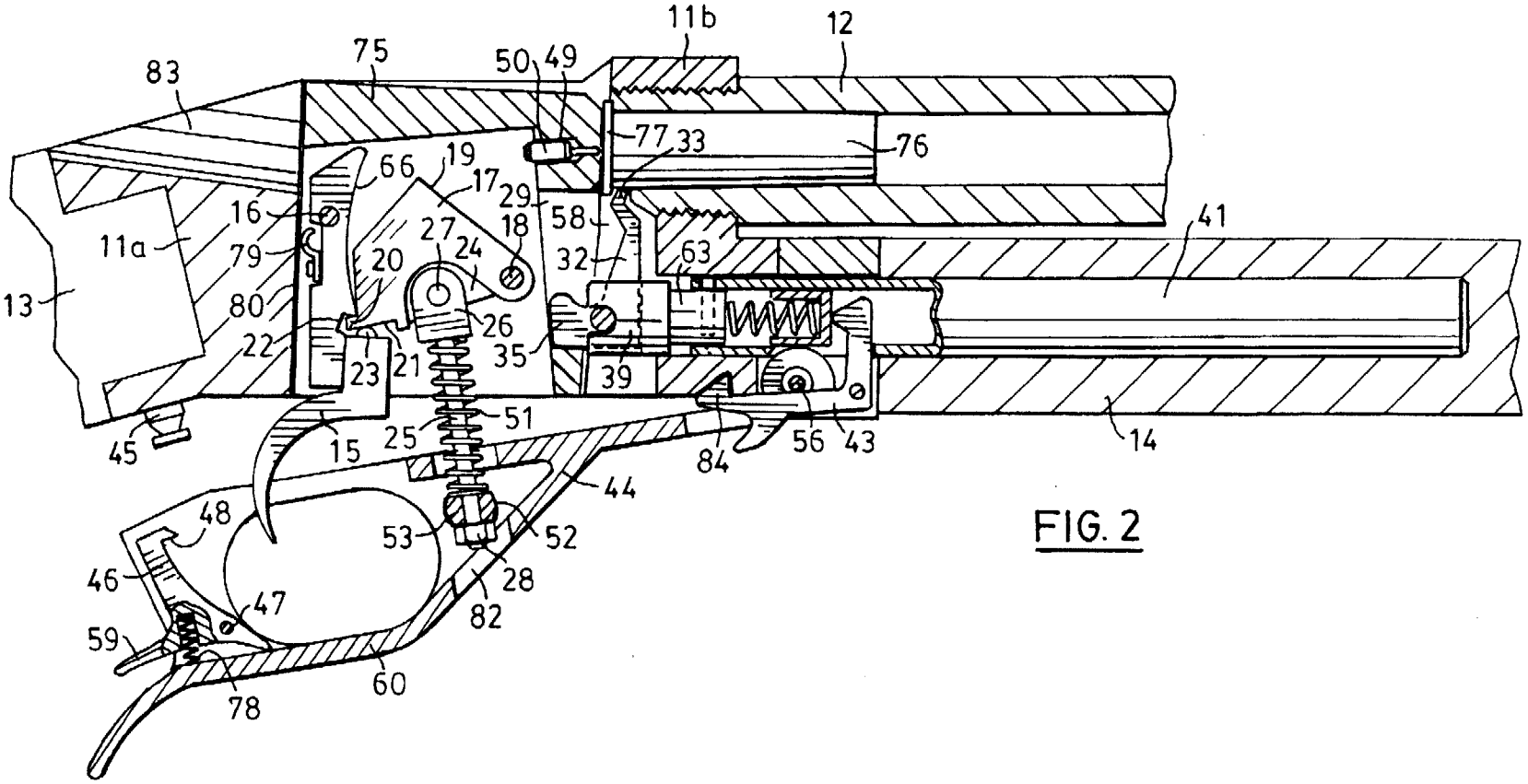
FIG. 2 is a cross-sectional view of the breechblock mechanism of FIG. 1 but after the hammer has been moved to a cocked position.

As will be seen from FIG. 2, when the firearm is to be cocked, lever arm 44 is unlatched by pressing arm 59 and thus disengaging catch 48 from lever latch post 45. This allows underlever 44 to be pulled downwards about pivot pin 56. As underlever 44 rotates downwardly about pivot pin 56, nut 28 rests against shaft pivot 53, thus preventing further movement of shaft 25 through shaft pivot 53. Further downward movement of underlever 44 causes hammer 17 to be rotated about pivot pin 18 and sear 20 slides along surface 66 of trigger 15 until surface 21 comes in contact with stop surface 23. Trigger 15 is biased forwards by a spring 79. In the embodiment shown in the drawings, the rear of breechblock 75 is open and thus the trigger spring e.g. a leaf spring, would bear upon the wall 80 of rear portion of receiver 11*a*. It will be understood that the rear of breechblock 75 could be closed with a rear wall and then the trigger spring would bear upon the inside of the rear breechblock wall. An advantage of the latter arrangement is that there is no sliding wear between the spring and the rear portion of receiver 11*a*. An advantage of the former arrangement is the simplicity of manufacture. When sear 20 reaches detent 22, trigger 15 is forced forward until sear 20 is engaged within detent 22. Movement of hammer 17 in this manner, allows firing pin 50 to move. For example, it allows firing pin 50 to move away from contact with a loaded cartridge 81. Shaft nut 28 is in contact with shaft pivot 53. Although the hammer is cocked, in the traditional sense, compression spring 51 is not fully compressed. The firearm thus is not able to be accidentally discharged.

As will be seen more clearly in FIG. 3, which shows the breech mechanism in the eject position, if the underlever 44 is moved downwards even more, breechblock 75 is pulled downwards. This is because pivot pin 18 is attached to breechblock 75 and hammer 17 cannot rotate further because of contact of surface 21 with stop surface 23, and because shaft nut 28 is in contact with shaft pivot 53. Breechblock 75 is moved downwards sufficiently for upper wall 30 of front aperture 29 to engage with toe 36 of extractor 32. Further downward movement of breechblock 75 causes pressure on toe 36 and rotation of extractor 32 about pivot pin 38. Extractor 32 is thus forced to rotate and, if a cartridge, e.g. a spent cartridge 76, is in the cartridge chamber, the upper tip 33 of extractor 32 pushes against the rim 77 of the cartridge 76 and extracts the cartridge from the chamber. The cartridge 76 may then travel along the top of breechblock 75 and channel 83 and be ejected. Continued rotation of extractor 32 is prevented by contact of a rear face of extractor 32 with a front face of breechblock 75. Further lowering of breechblock 75 is prevented by the contact of upper wall 30 and toe 36. During rotation of extractor 32, the lower forward tip 67 of extractor 32 presses against bearing surface 64 of extractor retainer 39 and pushes extractor retainer 39 against the force of spring 40, as will be seen in more detail in FIG. 6B. Any spent cartridge is therefore removed and the firearm is in readiness for insertion of a fresh cartridge.

Figure 4:
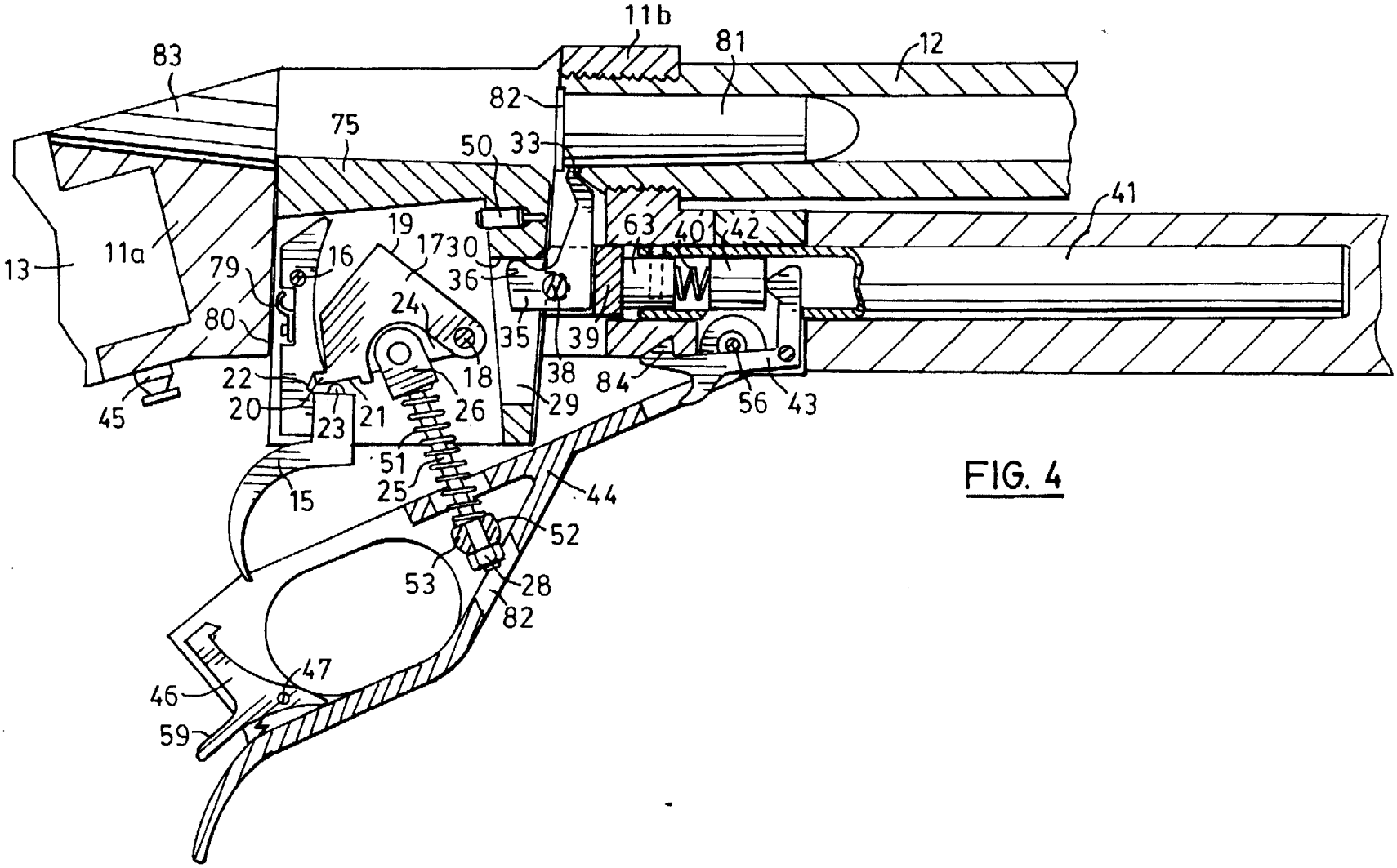
FIG. 4 is a cross-sectional view of the breechblock mechanism of FIG. 1 but in a loaded position.

A fresh cartridge 81 may be inserted, when the breech mechanism is in the position shown in FIG. 3 or in its load position as shown in FIG. 4. When a new cartridge 81 is passed along channel 83, across the top of breechblock 75 and pressed into the barrel chamber, the rim 82 of fresh cartridge 81 engages with upper tip 33 of extractor 32. The extractor 32 is rotated clockwise and in so doing the breechblock 75 is raised slightly as a result of leverage of extractor 32 and the upward pressure of toe 36 on upper wall 30 of front cavity 29. As will be understood, the breechblock 75 can also be raised by moving the underlever upwards. Rotation of extractor 32 about pivot pin 38 is also assisted by the pressure of spring 40 upon extractor retainer 39, which in turn presses against the lower forward tip 67 of extractor 32.

Figure 5:
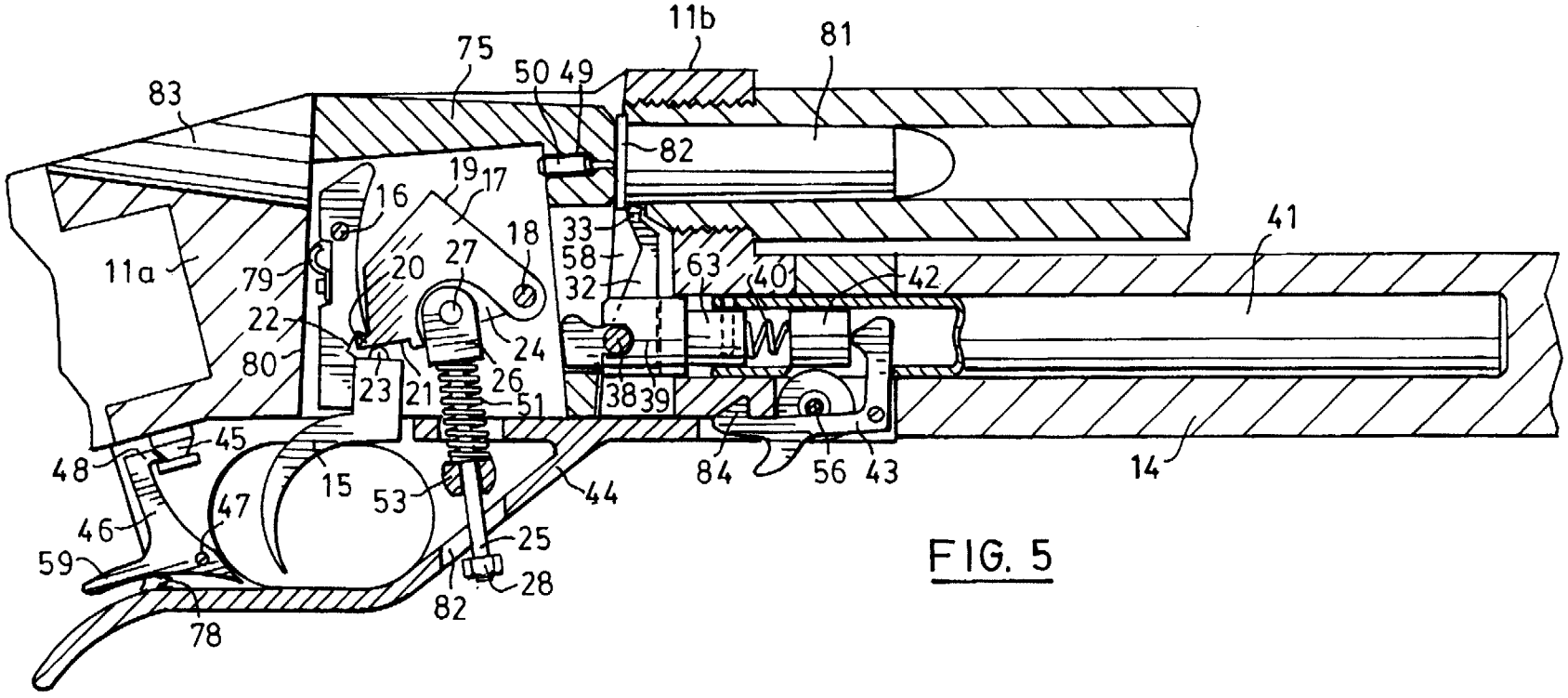
FIG. 5 is a cross-sectional view of the breechblock mechanism of FIG. 1 but in a cocked and ready-to-fire position.

In order to move the mechanism into the ready position, (sometimes known as the firing position), the underlever 44 is raised until catch 48 of lever latch 46 engages with lever latch post 45, as shown in FIG. 5. As underlever 44 is raised towards this position, breechblock 75 is raised partly as a result of pressure of compression spring 51 between shaft 53 and linkage 26. This occurs because the hammer and trigger are locked by sear 20 and detent 22, and hammer 17 cannot be rotated about pivot pin 18. In the ready position, spring 51 is compressed. Shaft 25 protrudes through shaft pivot 53 and aperture 82 in underlever 44. The distance between pivot link 26 and shaft pivot 53, when in the ready position is arranged so that the spring 51 cannot be overcompressed. In the ready position, rearward movement of trigger 15 disengages sear 20 from detent 22, thus allowing the spring 51 to force hammer 17 rotatably around pivot pin 18. The face 19 of hammer 17 will then strike firing pin 50 and drive the firing pin forward so that firing pin 50 will strike the cartridge 81 and discharge the firearm.

As breechblock 75 is raised towards the position shown in FIG. 5, even if hammer 17 is released by pulling trigger 15, face 19 will not touch firing pin 50 because hammer 17 is prevented from so doing by stop nut 28 coming in contact with shaft pivot 53. Indeed such prevention will occur up to a position where underlever 44 is within a few degrees of closure. The gap between stop nut 28 and shaft pivot 53 as shown in FIG. 1 determines how far the underlever 44 must be lowered in order to avoid firing of the firearm.

In the ready position, shown in FIG. 5, underlever 44 is butted up against the underside of receiver 10 and the underside of breechblock 75.

The breechblock and extractor mechanisms are believed to be unique. In addition, the cooperation between extractor 32 and the breechblock 75 is believed to be unique. The pivot pin 38 passes through extractor 32 and provides a pivot point for its rotation. Locating slot 62 of extractor retainer 39 traps the extractor 32 between the breechblock 75 and the extractor retainer 39. The toe 36 and heel 35 of extractor 32, together with upper wall 30 and lower wall 31 of front aperture 29 govern the amount of travel permitted to the breechblock 75. This arrangement allows the downward travel limit of breechblock 75 to be tailored to the calibre of cartridge for which each particular firearm is built. By selecting an extractor with a shorter or longer distance between toe 36 and heel 35, the breechblock travel can be increased or decreased.

The functions of extractor retainer 39 are now explained more fully with reference to FIGS. 6A and 6B. In these Figures, extractor retainer 39 has a chamfered upper edge 70 which is cooperable with a mating shoulder 71 on a forward face of breechblock 75. The location of mating shoulder 71 is such that cooperation of chamfered edge 70 and mating shoulder 71 only occurs when the breechblock 75 is in the fully up position as shown in FIGS. 1, 2 and 5 and is designed to impede or retard the downward movement of the breechblock. Extractor retainer 39 also traps extractor 32 and retains it in position during operation of the breechblock action. The spring pressure exerted by compression spring 40 also allows extractor retainer 39 to push against lower forward tip 67 of extractor 32 and thus position extractor 32 so that it does not interfere with the upward movement of breechblock 75.

The function of shoulder 71 and mating chamfered edge 70 is not necessary to the functioning of the breechblock mechanism, but is a preferable addition. An alternative to the mating shoulder and chamfered edge is a spring ball and cup catch.

In order to disassemble the firearm, it is desirable that the firearm not be in the firing position.

Figure 7:
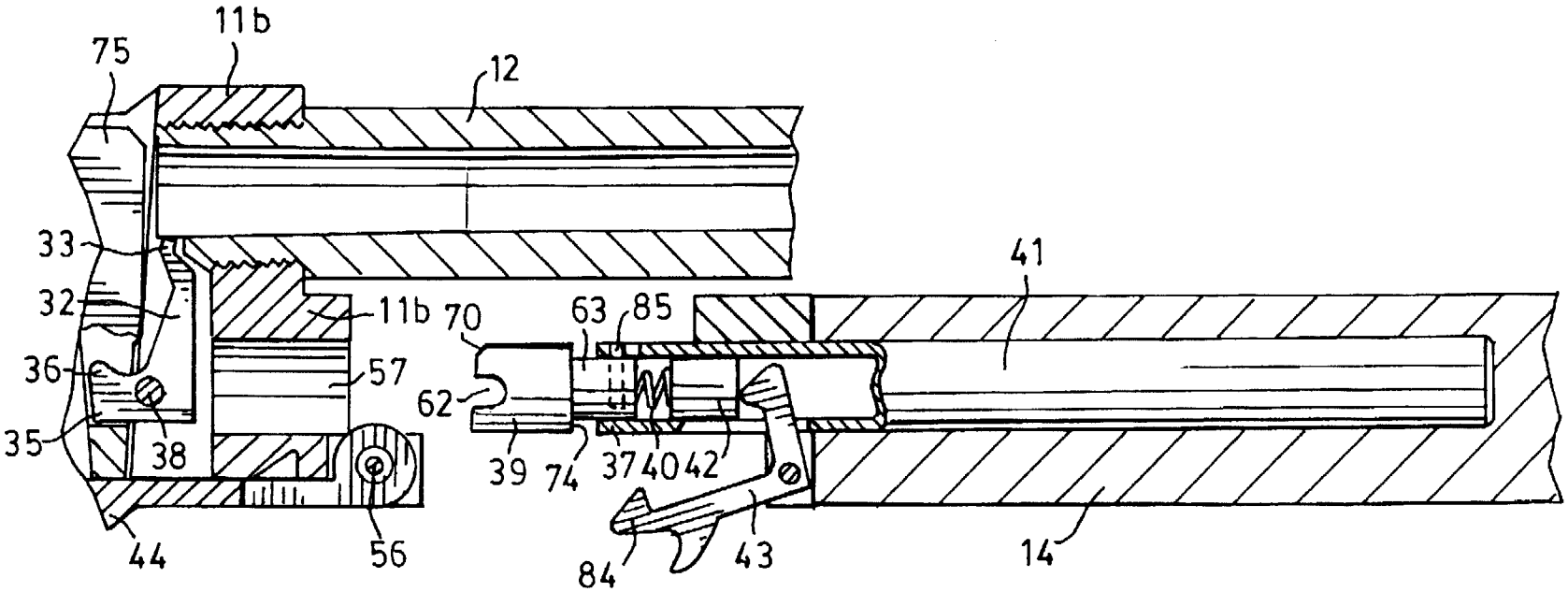
FIG. 7 is a cross-sectional detached view of a detail of the extractor latch mechanism.

Fore-end latch 43 is normally held in place by latching to the firearm, e.g. to the underside of the front portion receiver **11*b*, using catch 84. When fore-end latch 43 is unlatched, a fore-end assembly, comprising forearm 14, tube 41, fore-end latch 43, piston 42, compression spring 40 and extractor retainer 39, can be removed as a unit from the firearm, as shown in FIG. 7. Extractor retainer 39 is held in tube 41 by the head of a screw 85 which is loosely held in an elongated slot 86 in tube 41. The extractor retainer 39 disengages from the extractor pivot 38, so that extractor 32 is loose, thus allowing extractor 32 to slide out of the bottom of extractor chamber 58 as breechblock 75 is lowered. Thus extractor 32 is removed together with breechblock 75** through the bottom of the receiver.

The whole breechblock 75 and its associated components can then be removed merely by releasing latch 46 from latch post 45, thus allowing underlever 44 to be swung downwards. Then, by removing pivot pin 56, underlever 44, the breechblock assembly and extractor 32 can be removed entirely. The trigger 15 and hammer 17 can be released from breechblock 75 by removing pivot pins 16 and 18 respectively. This operation usually takes less than a minute. It can be appreciated that such a simple and easy disassembly and correspondingly easy assembly makes maintenance and replacement of parts extremely easy.

The present invention differs from previous falling block actions in that the underlever is not attached to the breechblock, but instead is attached to the hammer. This eliminates a great deal of the complexity of the breech action, e.g. removes a number of parts usually associated with getting the firing pin away from the cartridge prior to downward movement of the breechblock.

With reference to FIGS. 2 and 5 it was indicated that even though hammer 17 was in the cocked position, it was necessary for the underlever 44 to be latched in position, or nearly so, before the hammer 17 is able to strike firing pin 50. In previous firearms, blocking devices had been relied upon to prevent a previously compressed mainspring from driving the hammer forward onto the firing pin. In the present invention, there is no traditional safety catch and yet it is safer than any other falling breechblock firearm, when carried loaded in the configuration depicted in FIG. 2. When the firearm of the present invention is ready to fire, as in FIG. 5, in order to discharge the firearm it is necessary only to pull the trigger. The state of the gun is easily ascertainable by a visual and tactile indication of the location of shaft nut 28, which protrudes below the underlever 44 when in the ready position depicted in FIG. 5. As indicated hereinbefore, in a preferred embodiment the hammer 17 can only reach firing pin 50 when the underlever 44 is within a degree or so, or a few degrees, of being latched by latch 46 and latch post 45. Even with the hammer 17 in a cocked position, the firearm is entirely safe in the positions shown in FIGS. 2–4.

Another unique feature of one aspect of the present invention is that the extractor 32 governs and is governed by the movement of breechblock 75. The limitation of travel of the breechblock 75, as a result of the foot of extractor 32 being located inside aperture 29, allows the downward limit of travel of breechblock 75 to be tailored to the size of the cartridge for which the firearm is built. By selecting an extractor with a shorter of longer toe 36, the travel of breechblock 75 can be increased or decreased.

Advantages of the present invention are that the breechblock action is very tolerant to wear and tear or crude workmanship and yet remain safe and functional. The invention is applicable to any kind of firearm, even though it has been particularly described with respect to rifles adapted for rimmed cartridges.

Other advantages include the fact that many of the parts can be made not only from castings but also from stampings, thus making embodiments of the firearm within the reach of do-it-yourself enthusiasts as well as firearm manufacturers.

It will understood by those skilled in the art that in the configuration shown in the drawings, the load from the fired cartridge is on the rear wall. The breechblock and receiver mechanisms can be made lighter if the firing load is absorbed at the forward end of the receiver and breechblock. Such modifications are within the skill of one skilled in the art and would not alter the functioning of the action as described herein.

I claim:

1. A falling breechblock action for a single shot firearm which has an internal firing mechanism, comprising:

(a) a receiver mounted on one end of a barrel, and the receiver has a forward portion which joins the barrel, and a rearward portion separated from the forward portion by opposing sides, in which said sides, forward and rearward portions define an interior of the receiver;

(b) a breechblock which has a front face and upward, downward, rearward and frontward directions, said breechblock being separate from the receiver and slidable downwards and upwards within the interior of the receiver, said breechblock has a main cavity therein which is closed in the upward direction and open in the downward direction;

(c) an underlever which is pivotable about an axis adjacent the forward portion of the receiver;

(d) means for releasably holding the underlever in contact with substantially all of the underside of the receiver;

(e) a trigger which is pivotable about a transverse trigger pivot within the main breechblock cavity;

(f) a hammer which is pivotable about a transverse hammer pivot in the main cavity between a cocked position and a forward position, said trigger and hammer having cooperating latching means for releasably engaging said trigger and hammer in the cocked position; and (g) hammer control means which comprises a shaft, one end of which is pivotably linked to the hammer about a shaft link pivot which is rotatable about a transverse axis rearward of the hammer pivot, said shaft having an opposing end with stop means, and said shaft passes through a guide aperture in the underlever, and said shaft has an associated compression spring which is compressed between the shaft link pivot and material which surrounds the guide aperture.

2. A falling breechblock action according to claim 1 wherein the guide aperture and the material surrounding the guide aperture comprises a shaft pivot which is rotatable about a transverse axis in the underlever, in a pivot bearing in the underlever, said shaft pivot has a diametric aperture therethrough, perpendicular to the transverse axis, and the shaft has said associated compression spring which is compressed between the shaft pivot and the shaft link pivot.

3. A falling breechblock action according to claim 2 wherein there is a small gap between the stop means and the shaft pivot when the underlever is held in contact with the underside of the receiver.

4. A falling breechblock action according to claim 3 wherein the stop means is a nut which is threadedly attached to the shaft.

5. A falling breechblock action according to claim 1 wherein the latching means for the trigger and hammer is a cooperating sear and indented sear catch.

6. A falling breechblock action according to claim 2 wherein the latching means for the trigger and hammer is a cooperating sear and indented sear catch.

7. A falling breechblock action according to claim 2 wherein the trigger is spring biased towards a latched position for the latching means.

8. A falling breechblock action according to claim 2 wherein the means for releasably holding the underlever in contact with the underside of the receiver is a latching means.

9. A falling breechblock according to claim 3 wherein the stop means is a nut which is threadedly attached to the shaft, the latching means for the trigger and hammer is a cooperating sear and indented sear catch, the trigger is spring biased towards a latched position for the latching means and the means for releasably holding the underlever in contact with the underside of the receiver is a latching means.

10. A falling breechblock action according to claim 1 wherein the falling breechblock action additionally has:

(i) an extractor chamber in the receiver, wherein the extractor chamber is open in the rearward and downward directions and has a retainer bore leading from the chamber for retaining an extractor retaining means, said retainer bore having a longitudinal axis substantially parallel to a longitudinal axis of the barrel, and said receiver has an underside;

(j) the front of the breechblock having an extractor aperture communicable with the extractor chamber; and (k) an extractor which is pivotable within the extractor chamber about a transverse extractor pivot, and said extractor has an extractor arm extending upwardly from the extractor pivot, and an extractor foot extending from the extractor pivot substantially perpendicularly to the extractor arm, said foot having a toe and heel, and said foot extending into the breechblock aperture, said extractor being held in position by said extractor retaining means, such that the extractor pivot is in contact with the front face of the breechblock.

11. A falling breechblock action according to claim 2 wherein the falling breechblock action additionally has:

(i) an extractor chamber in the receiver, wherein the extractor chamber is open in the rearward and downward directions and has a retainer bore leading from the chamber for retaining an extractor retaining means, said retainer bore having a longitudinal axis substantially parallel to a longitudinal axis of the barrel, and said receiver has an underside;

(j) the front of the breechblock having an extractor aperture communicable with the extractor chamber; and (k) an extractor which is pivotable within the extractor chamber about a transverse extractor pivot, and said extractor has an extractor arm extending upwardly from the extractor pivot, and an extractor foot extending from the extractor pivot substantially perpendicularly to the extractor arm, said foot having a toe and heel, and said foot extending into the breechblock aperture, said extractor being held in position by said extractor retaining means, such that the extractor pivot is in contact with the front face of the breechblock.

12. A falling breechblock action according to claim 10 wherein the extractor aperture in the breechblock has upper and lower surfaces, said upper surface is cooperable with the toe of the extractor when in a cartridge ejection position to rotate the toe about the extractor pivot and cause the extractor arm to catch a rear portion of a cartridge and eject the cartridge rearwardly from the barrel.

13. A falling breechblock action according to claim 10 wherein the extractor arm is shaped to catch a rim of a cartridge.

14. A falling breechblock action according to claim 10 wherein the extractor retaining means is a spring biased plunger with first bearing surfaces which bear upon the extractor pivot, urging the plunger into contact with the front face of the breechblock.

15. A falling breechblock action according to claim 14 wherein the plunger has a second bearing surface which bears upon a lower portion of the extractor arm when the extractor is in the ejection position, urging the extractor to rotate about the extractor pivot.

16. An extractor mechanism for a single shot firearm, comprising:

(a) a receiver mounted on one end of a barrel, and the receiver has an underside, a forward portion which joins the barrel, and a rearward portion separated from the forward portion by opposing sides, in which said sides, forward and rearward portions define an interior of the receiver, said receiver having an extractor chamber which is open in the rearward and downward directions and has a retainer bore for retaining an extractor retaining means, said retainer bore having a longitudinal axis substantially parallel to a longitudinal axis of the barrel;

(b) a breechblock which has a front face and upward, downward, rearward and frontward directions, said breechblock being separate from the receiver and slidable downwards and upwards within the interior of the receiver, the front face of the breechblock having an extractor aperture communicable with the extractor chamber.

(c) an extractor which is pivotable within the extractor chamber about a transverse extractor pivot, said extractor has an extractor arm extending upwardly from the extractor pivot, and an extractor foot extending from the extractor pivot substantially perpendicularly to the extractor arm, said foot having a toe and heel, and said foot extending into the breechblock aperture, said extractor being held in position by said extractor retaining means, such that the extractor pivot is in contact with the front face of the breechblock.

17. An extractor mechanism according to claim 16 wherein the extractor aperture in the breechblock has upper and lower surfaces, said upper surface is cooperable with the toe of the extractor when in a cartridge ejection position to rotate the toe about the extractor pivot and cause the extractor arm to catch a rear portion of a cartridge and eject the cartridge rearwardly from the barrel.

18. An extractor mechanism according to claim 16 wherein the extractor arm is shaped to catch a rim of a cartridge.

19. An extractor mechanism according to claim 16 wherein the extractor retaining means is a spring biased plunger with first bearing surfaces which bear upon the extractor pivot, urging the plunger into contact with the front face of the breechblock.

20. An extractor mechanism according to claim 19 wherein the plunger has a second bearing surface which bears upon a lower portion of the extractor arm when the extractor is in the ejection position, urging the extractor to rotate about the extractor pivot.

* * * * *